US005845705A

United States Patent [19]

Vinh et al.

[11] Patent Number: 5,845,705

[45] Date of Patent: Dec. 8, 1998

[54] TANK TO HEADER JOINT FOR HEAT EXCHANGERS

[75] Inventors: Binh Vinh, Lakewood; Dale W. Hermann, Torrance, both of Calif.

[73] Assignee: AlliedSignal Inc., Morristown, N.J.

[21] Appl. No.: 554,951

[22] Filed: Nov. 13, 1995

[51] Int. Cl.[6] ..... F28F 9/02

[52] U.S. Cl. ..... 165/173; 165/175

[58] Field of Search ..... 165/173, 151, 165/153, 175

[56] References Cited

U.S. PATENT DOCUMENTS

| | | | |
|---|---|---|---|
| 3,583,478 | 6/1971 | Fieni | 165/175 X |
| 3,810,509 | 5/1974 | Kun . | |
| 4,305,459 | 12/1981 | Nonnemann et al. | 165/173 |
| 4,401,157 | 8/1983 | Cadars | 165/173 |
| 4,651,821 | 3/1987 | Moranne | 165/175 |
| 4,949,543 | 8/1990 | Cottone et al. . | |
| 4,951,371 | 8/1990 | Dalo et al. . | |
| 4,955,525 | 9/1990 | Kudo et al. . | |
| 5,097,891 | 3/1992 | Christensen . | |
| 5,160,474 | 11/1992 | Huff | 165/173 X |
| 5,267,624 | 12/1993 | Christensen . | |

FOREIGN PATENT DOCUMENTS

| | | | |
|---|---|---|---|
| 1039911 | 10/1953 | France | 165/173 |
| 2624595 | 6/1989 | France | 165/173 |
| 158698 | 7/1991 | Japan | 165/173 |
| 1012002 | 4/1983 | U.S.S.R. | 165/173 |
| 1097885 | 6/1984 | U.S.S.R. | 165/173 |
| 1278566 | 12/1986 | U.S.S.R. | 165/173 |
| 1322070 | 7/1987 | U.S.S.R. | 165/173 |

*Primary Examiner*—Leonard R. Leo
*Attorney, Agent, or Firm*—Felix L. Fischer; John R. Rafter

[57] ABSTRACT

In heat exchanger such as an automotive radiator, an improved tank to header joint is provided. The header and tank can be provided hooks shaped portion and cooperating tabs that are assembled in an interlaced and locked together by a pin inserted therebetween. An elastomeric seal is can be disposed between the opposed surfaces of the tank and header.

3 Claims, 6 Drawing Sheets

TANK TO HEADER JOINT FOR HEAT EXCHANGERS

FIELD OF INVENTION

This invention relates generally to aluminum parallel tube heat exchangers for cooling fluids such as can be used for automotive engine applications as radiators, oil coolers and charge air coolers. This invention provides a heat exchanger such as a radiator having an improved stress reducing quick release tank to header joint which for instance can be employed between a metal core and a plastic or metal tank of an automotive heat exchanger such as a radiator.

RELATED APPLICATIONS

This application is related to U.S. patent copending application Ser. No. 08/554,952 for an Improved Tube To Header Joint and copending U.S. patent application Ser. No. 08/554,453 for an Improved Cooling Tube For Heat Exchangers filed concurrently herewith. These application are assigned to the assignee hereof and the disclosures of these applications are incorporated by reference herein.

BACKGROUND

Engine system components are being scrutinized to reduce weight, improve durability and serviceability to thereby improve engine performance. Typically heat exchangers for use in automotive applications such as radiators, oil coolers and charge air coolers can comprise a series of interlaced flow passages. A first hot circuit is designed to carry heat away from the engine. The first hot circuit can for instance comprises a series of tubes. A first fluid engine coolant such as a heat conductive fluid, for instance treated water or oil, flows in a first hot closed circuit from the engine to the heat exchanger intake, through the heat exchanger to an engine return. A second cooling circuit for extracting heat from the hot circuit preferably flows in an open circuit about the first circuit. The cooling circuit can comprise a series of finned open passages disposed between the hot circuit tubes. A cooling fluid such as for instance ambient air can flow in the second circuit. These hot and cold circuits can be alternated to form a stacked array. Headers are used to connect the flattened tubes and form a portion of a closed fluid circuit. The joint between the header plate and the tube and the joint between the tank and header plate are extremely sensitive to applied stresses and in many cases are key factors in heat exchanger durability.

Automotive heat exchangers such as radiators, oil coolers and charge air coolers are subject to operational stresses induced by vibration, thermal expansion and pressure variations. Truck heat exchangers typically operate in the range of 8–12 PSI; passenger car heat exchanged typically operate in the range of 18–25 PSI; charge air coolers typically operate in the range of 30–35 PSI, oil coolers typically operate in the range 40–45 PSI and air-conditioning condensers typically operate in a range of up to 400 PSI.

It is important to ensure heat exchangers are constructed with a mechanically sound and hermetically sealed connection between the tank and the header that can resist mechanical vibration and stress. Heretofore, tanks and headers have been joined in bolted, crimped, solder or brazed joints. These joints can not be easily opened in the event the interior the heat exchanger needs to be repaired. Further, joining mechanisms such as these are labor intensive and add cost to the product. Moreover the seal between the tank and header joint is integral with the mechanical joint and can rupture as the heat exchanger is exposed to operational stress. A need therefore exists for an improved heat exchanger tank to header sealed joint.

SUMMARY OF THE INVENTION

It is a principle object of this invention to provide a brazed aluminum heat exchanger for use in an engine system having an improved tank to header joint that significantly improves the durability, serviceability and life of the heat exchanger.

The tank header joint of the present invention preferably provides for easy assembly and disassembly.

Another object of the invention is also directed to prolonging heat exchanger service life by employing corrosion resistant materials such as aluminum, composite or plastic materials.

It is a principle object of the invention to provide a heat exchanger tank that can be joined and hermetically sealed to the header plate by a flexible sealing ring such as an O-ring that can be compressed between the header and the tank.

In a preferred embodiment an easily assembled tank to header joint for a parallel tube heat exchanger in accordance with the present invention includes a header plate having formed tank receiving member extending in a direction substantially parallel to the axis of the parallel tubes. The header member can include a first locking end portion selected form the group consisting of spaced tabs and U shaped members. A tank can have a formed header receiving member extending in a direction substantially parallel to the axis of the parallel tubes for sealed application to the header plate. The tank can have a formed header receiving member including a second locking end portion selected form the group consisting of spaced tabs and U shaped members. An elastomeric seal can be disposed between the formed tank header receiving members. A removable locking wire rod or pin can be inserted between the first and second locking members wherein the inserted wire rod or pin alternately contacts the spaced tabs and U shaped members.

A heat exchanger in accordance with the present invention includes a flexible sealing ring disposed between the tank and header. A series of pins or a continuous wire rod can between cooperating keepers on the tank and header to hold the header and tank in floating contact, allowing for approximately 0.040–0.080 inches of travel between them to alleviate thermal stress in the tank to header joint. Typically, the cooling tubes and header are mechanically fixed and materially joined to each other and the tank joint, tubes and header must be capable of withstanding operational stresses induced by thermal expansion of the tubes as well as the vibration and pressure produced by the engine environment.

As a result of the improved tank to header joint, the present invention provides for an improved head exchanger which exhibits improved durability, stress and pressure resistance.

BRIEF DESCRIPTION OF THE DRAWINGS

Other objects and features will be apparent from the following specification taken in connection with the accompanying drawings in which.

DESCRIPTION OF BEST MODE OF CARRYING OUT THE INVENTIONS

Figure 1:
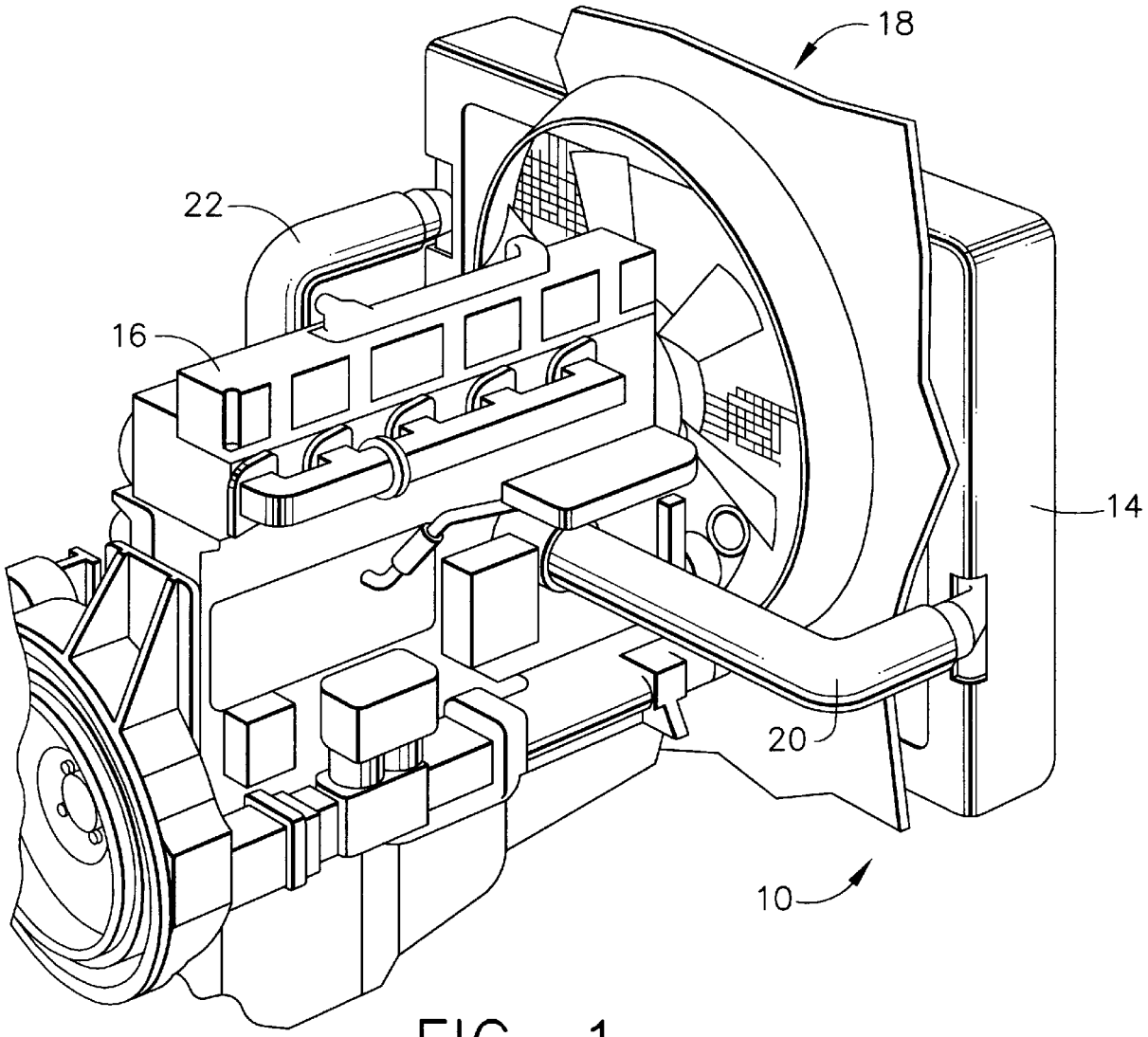
FIG. 1 is an illustration of a heat exchanger cooling system in combination with an engine system.

Referring now to FIG. 1, an illustration of an engine cooling system 10 is shown to include a heat exchanger 14 such as a radiator, oil cooler or charge air cooler in front mounted relationship with an internal combustion engine 16. Typically the heat exchanger 14 is mounted forward of a vehicle (not shown) and receives headwinds generated by vehicle movement as well as vibrational and torsional stresses developed from vehicle and engine operation. An engine cooling circuit 18 includes a supply tube 20 coupled between the engine 16 and a hot side of the heat exchanger 14 for channeling a hot fluid from the engine 16 to the heat exchanger 14 and a return tube 22 coupled between the heat exchanger 14 and the engine 16 for channeling a cooled fluid from the heat exchanger 14 to the engine 16.

Figure 2:
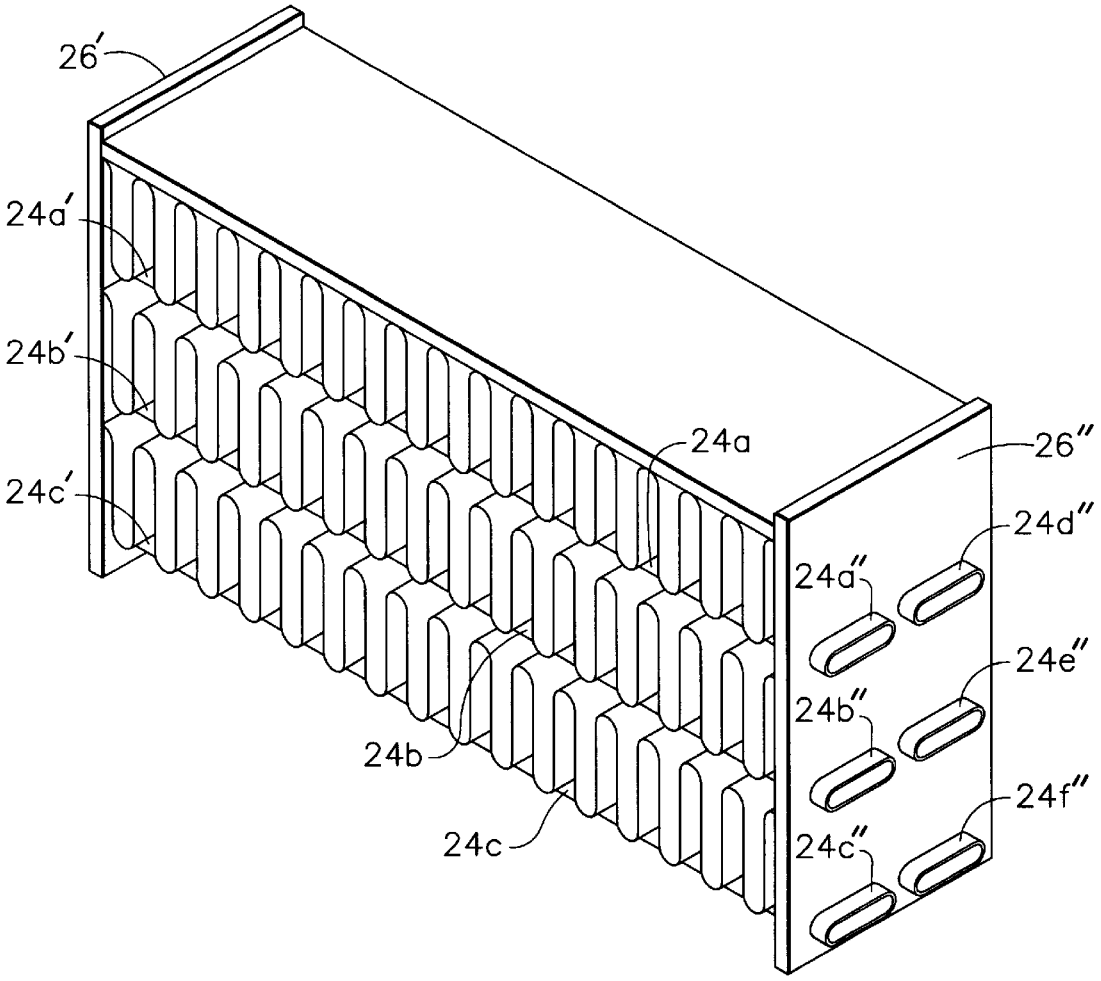
FIG. 2 is an illustration of a side perspective view of heat exchanger core.

Referring now to FIG. 2, an illustration of a schematic representation of a typical heat exchanger core 14 is shown wherein flattened aluminum tubes 24*a*, 24*b*, 24*c*, 24*d*, 24*e* and 24*f* are sealed in a jointed connected at their first and second opposite tubes ends 24*a*', 24*b*', 24*c*', 24*d*', 24*e*' and 24*f*' and 24*a*", 24*b*", 24*c*", 24*d*", 24*e*" and 24*f*" respectively to header plates 26' and 26". Typically the header plates 26' and 26" can have an opening have for receiving the first and second flattened tube ends 24*a*', 24*b*', 24*c*', 24*d*', 24*e*' and 24*f*' and 24*a*", 24*b*", 24*c*", 24*d*", 24*e*" and 24*f*" there through. Further details of the tube construction can be found in copending U.S. patent application Ser. No. 08/554,953 for an Improved Cooling Tube For Heat Exchangers the disclosure of which is incorporated by reference herein.

Further details of the connection between the tubes and the header plate can be found in copending U.S. patent application Ser. No. 08/554,952 for an Improved Tube To Header Joint, assigned to the assignee hereof and incorporated by reference herein. Aluminum fins 28 can be disposed between parallel tubes 24*a*, 24*b*, 24*c*, 24*d*, 24*e* and 24*f* to enhance heat transfer form the tubes. Side plates 30 extend between and are rigidly affixed to the header plates 26' and 26".

Figure 3A:
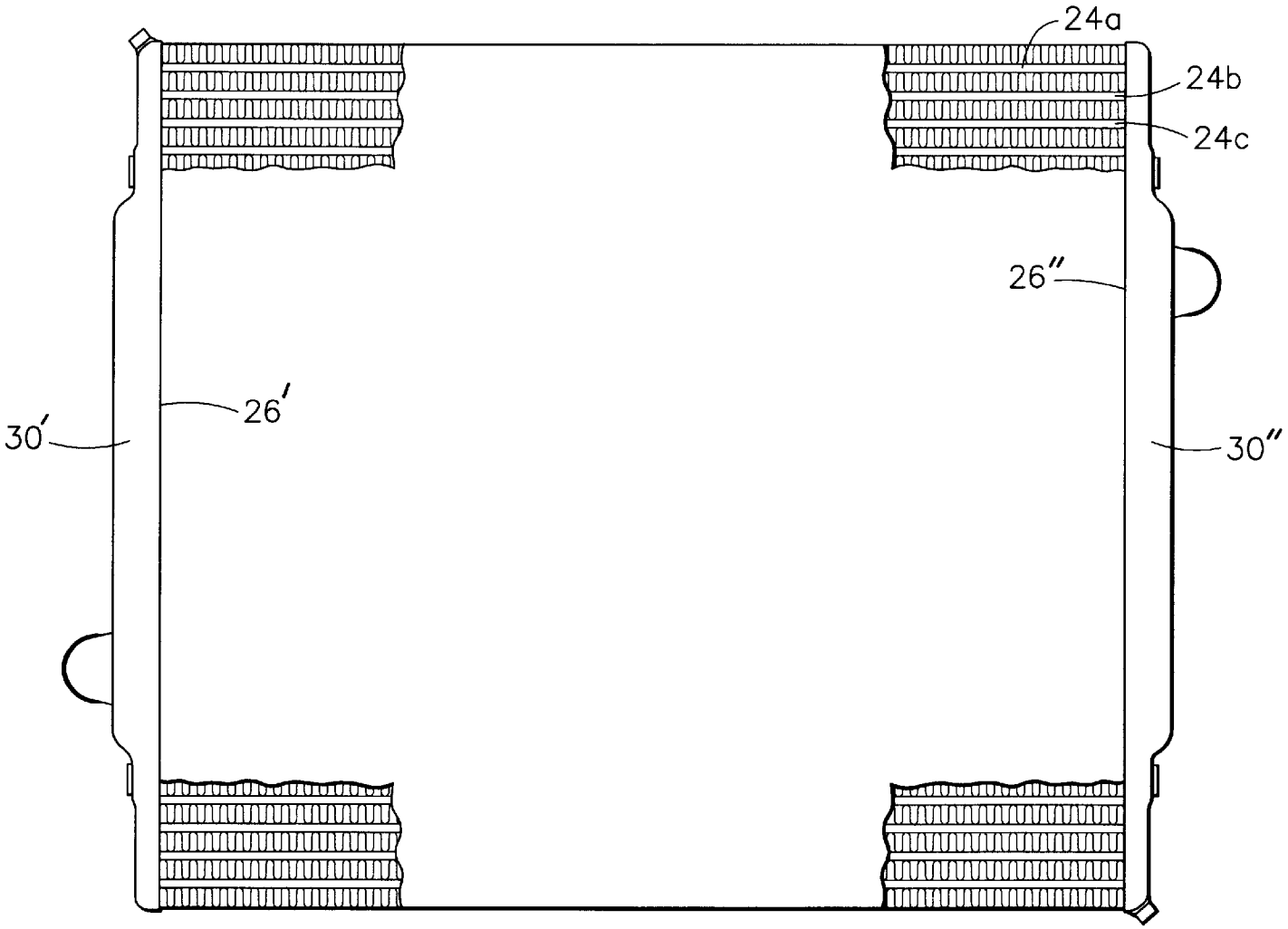
FIG. 3*a* is an illustration of a front elevational view of an assembled heat exchanger such as a radiator including tubes coupled to header plates that are coupled with side tanks.
Figure 3B:
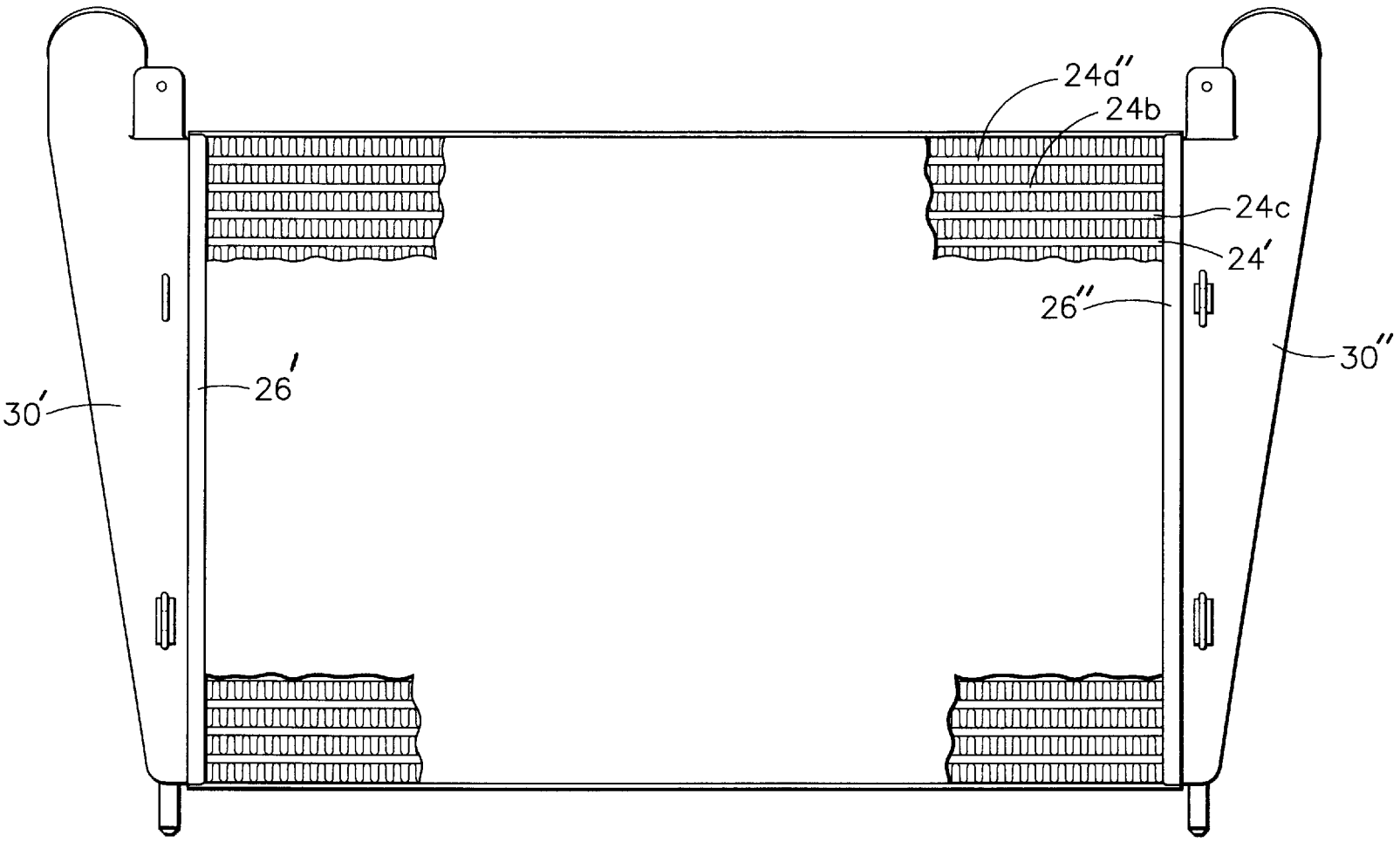
FIG. 3*b* is an illustration of a front elevational view of an assembled heat exchanger such as a charge air cooler including tubes coupled to header plates that are coupled with side tanks.

FIGS. 3*a* and 3*b* show heat exchangers a radiator and charge air cooler respectively. Side tanks 30' and 30" in FIG. 3, can be sealingly applied to the header plates 26" and 26' respectively to form a closed heat exchanger from the heat exchanger core of FIG. 2. More specific details of the connection between the side tanks 30' and 30" and the header plates 26' and 26" respectively can be found FIGS. 4*a*+*b*–11 below.

Figure 4A:
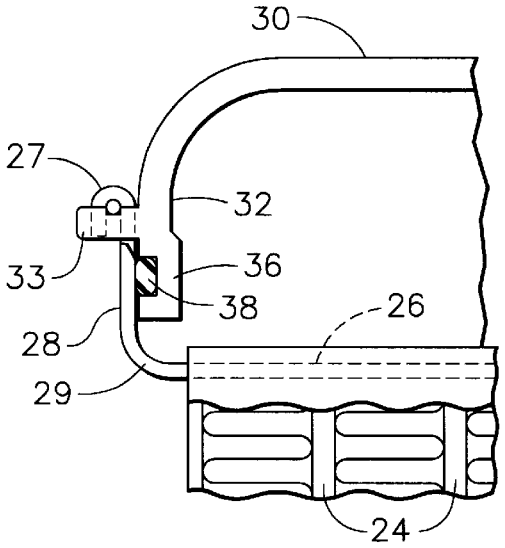
FIGS. 4*a* and 4*b* are illustrations of a cross-sectional view of a tank to header joint in accordance with the present invention.
Figure 4B:
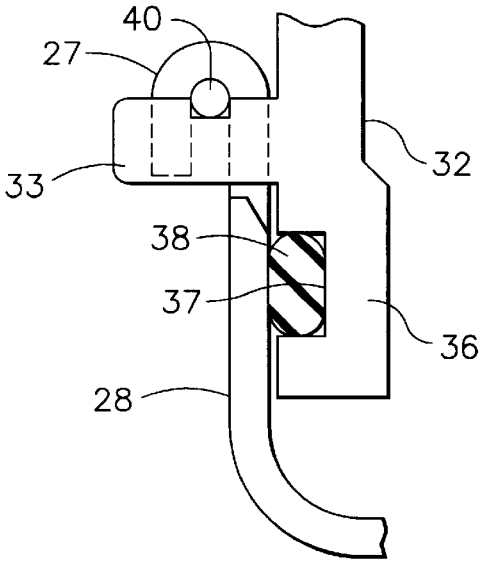

Referring now to FIGS. 4*a* and 4*b*, illustrations of a cross sectional view of a tank to header joint in accordance with a preferred embodiment of the present invention are shown. A header plate 26 includes a formed tank receiving member 28 extending from an edge of the header plate 26 and forming a substantially right angle bend 29 to extend in a direction substantially parallel to the axis X of the substantially parallel tubes 24. The header member 26 can including a first locking end portion or keeper 27 selected from the group consisting of spaced tabs and U shaped members. In the embodiment illustrated in FIG. 4*a* and FIG. 4*b* the tank receiving portion 28 of the header member 26 includes a U-Shaped end portion 27 that terminates in a direction substantially parallel to the axis X of the tubes 24.

The tank 30 can have a formed header receiving member 32 extending in a direction substantially parallel to the axis X of the parallel tubes for sealed application to the header plate 26. The formed header receiving member 32 of the tank 30 can have a second locking end portion or tank keeper 33 to cooperate with the header keeper 27. The tank keeper 33 can also be selected from the group consisting of spaced tabs and U shaped members. In the illustrated embodiment the tank 32 includes keeper comprised of a series of spaced tabs 33 that are interlaced with the U-shaped header keeper 27. The tank 32 also includes an end seal portion 36 for sealing the tank 32 to the header 26. The end portion 36 can also extend in a direction substantially parallel to the axis X of the tubes 24. The tank end portion 36 can include a channel 37 for receiving a elastomeric seal 38 therein. Appropriate selection of the seal achieves floating contact between the header 26 and the tank 32 to allow 0.040–0.080" travel between the header 26 and the tank 28 to alleviate thermal stress between the parts. It is preferred that the cross sectional area of the seal 38 be approximately 200% of the cross sectional area of the channel 37 wherein the seal 38 is compressed by approximately 50% during assembly of the tank 30 and header 26. The formed tank portion 32 can be inserted within the formed header portion 28 wherein the U-shaped hook 28 and the tabs 33 interlace with each other and a removable locking wire rod or pin 40 (shown in end view, see FIG. 11) is inserted between the header U-shaped hook 27 and the tank tab 53 wherein the wire rod or pin 40 alternately contacts the spaced tab 33 and U-shaped hook 27 to join, hermetically sealing and mechanically lock the header 26 to the tank 30. Advantageously the wire rod 40 can be easily withdrawn to release the lock and allow the header 26 and the tank 30 to be separated for service.

Figure 5:
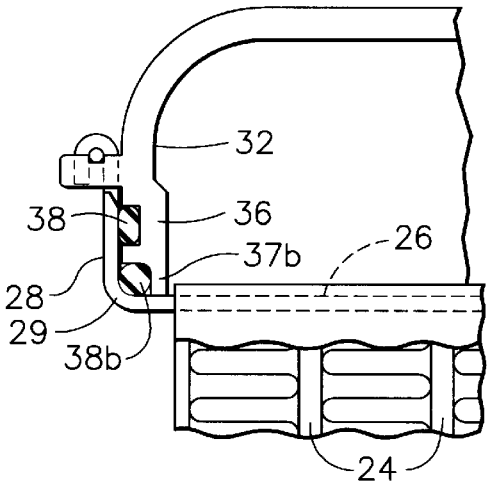
FIG. 5 is an illustration of a cross-sectional view of a tank to header joint in accordance with the present invention.

FIG. 5 is an illustration of a cross sectional view of a tank to header joint in accordance with the an alternate preferred embodiment of the present invention wherein a header plate 26 includes a formed tank receiving member 28 similar to that described in relation to FIGS. 4*a* and 4*b*. The formed header receiving member 32 of the tank 30 is similar to that illustrated in FIGS. 4*a* and 4*b* with an enhancement to the tank end portion 36. In this embodiment, the tank end portion 36 can be extended along the x-axis toward the header 26. Further the tank end portion 36 can include a second channel 37*b* proximate the header bend 29. The second channel 37*b* can also receive an elastomeric face seal 38*b* therein to additionally hermetically sealing the tank 30 to the header 26. The face seal 38*b* provides hermetic sealing contact between the tank 30 and the header 26 along not only the header surface parallel to the tube axis X and also on the header surface transverse to the tube axis X.

Figure 6:
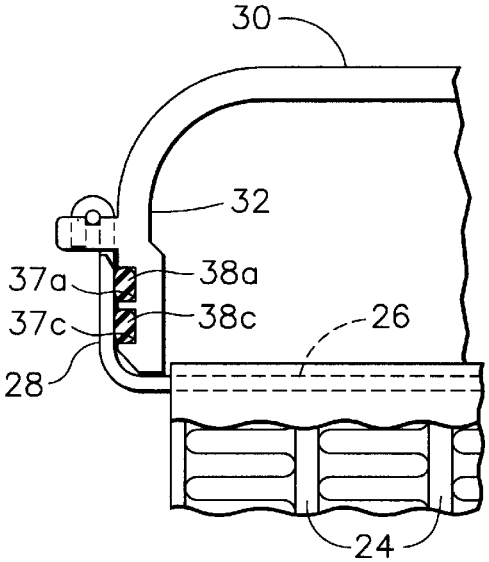
FIG. 6 is an illustration of another cross-sectional view of a tank to header joint in accordance with the present invention.

FIG. 6 is an illustration of a cross sectional view of a tank to header joint in accordance with an alternate preferred embodiment of the present invention wherein a header plate 26 includes a formed tank receiving member 28 similar to that described in relation to FIGS. 4*a*+*b* and 5 and a tank end portion 36 similar to that illustrated in FIG. 5 that extends within the header bend 29. The tank end portion 36 also includes a second seal receiving channel 37*c* however the channel 37*c* is displaced from the header bend 29 and is positioned closer to the first channel 37*a* than the header bend 29. upon joining of the tank 30 to the header 26, seals 38*a* and 38*c* are inserted channels 37*a* and 37*c* respectively. This double seal, 38 and 38*c*, provides hermetic sealing contact between the tank 30 and the header 26 along their respective surfaces substantially parallel to the tube axis X.

Figure 7:
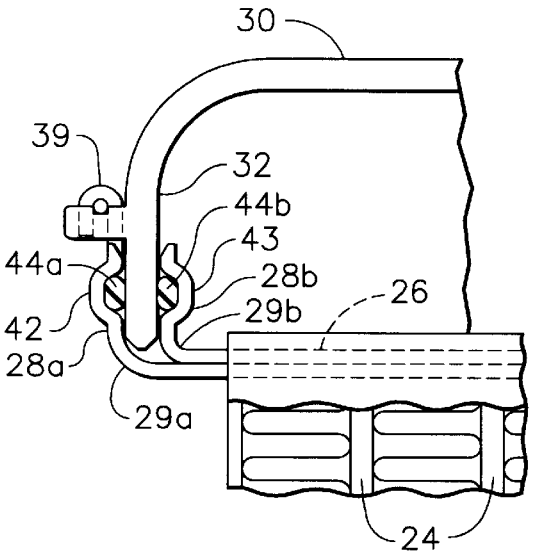
FIG. 7 is an illustration of a cross-sectional view of a tank to header joint in accordance with the present invention.

Referring now to FIG. 7 an illustration is shown of a cross sectional view of another alternate preferred embodiment of a tank to header joint in accordance with an alternate preferred embodiment of the present invention. A header plate 26 includes a bifurcated end portion formed into first and second tank receiving members 28*a* and 28*b* respectively. The tank receiving members 28*a* and 28*b* extend from the edge of the header plate 26 and form substantially right angle bends 29*a* and 29*b* to extend in a direction substantially parallel to the axis X of the substantially parallel tubes 24. The formed header member 28*a* can including a first U shaped locking end portion 39 and a first channel 42 for receiving a first seal 44*a* therein. The second formed header member 29*b* also extends in a direction substantially parallel to the axis X can include a second channel 43 for receiving a second seal 44*b* therein. Upon assembly header receiving member 32 of the tank 30 also extends in a direction substantially parallel to the axis X and is inserted between the bifurcated formed tank receiving members 28*a* and 28*b* with seals 44*a* and 44*b* contacting outside and inside of header receiving member 32 of the tank 30.

Figure 8:
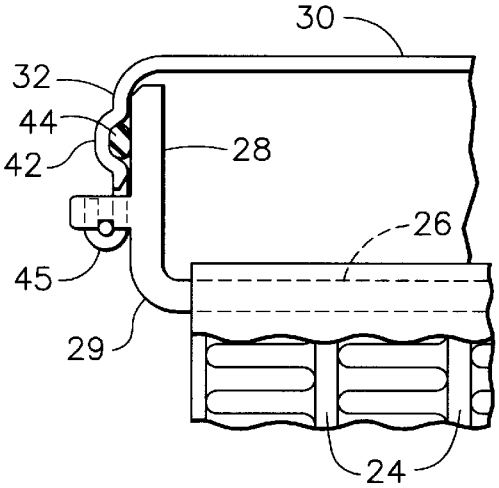
FIG. 8 is an illustration of a cross-sectional view of a tank to header joint in accordance with the present invention.

Referring now to FIG. 8 an illustration of a cross sectional view of a tank to header joint in accordance with a still further alternate preferred embodiment of the present invention is shown wherein a header plate 26 includes a formed tank receiving member 28 extending from the edge of the header plate 26 and forms substantially right angle bend 29 to extend in a direction substantially parallel to the axis X. The header member 28 can include a first locking end portion or keeper 27 is comprised of a plurality of spaced tabs 34.

The header receiving portion 32 of the tank 30 can be bent to extend in a direction substantially parallel to the axis X. The header receiving portion 32 of the tank 30 can include a channel 42 for receiving a seal 44 for sealed application of the tank 30 to the header 26. The header receiving portion 32 of the tank 30 can also include a second locking end portion 45 comprised of a plurality of U shaped members. In the illustrated embodiment a U-Shaped end portion terminates in a direction substantially parallel to the axis X. During assembly of the tank 30 and header 26 the formed tank portion 32 can be inserted within the formed header portion 28 and a seal 44 placed in the channel 42 wherein the U-shaped hooks 28 and the tabs 34 are interlaced with each other. A removable locking wire rod or pin 40 (shown in end view, see FIG. 11) can be inserted between the header U-shaped hook 28 and the tank tab 34 wherein the wire rod or pin 40 alternately contacts the spaced tab 34 and U-shaped hook 28 to join, hermetically sealing and mechanically lock the header 26 to the tank 30. Advantageously the wire rod 40 can be easily withdrawn to release the lock and allow the header 26 and tank 30 to be separated for service.

Figure 9:
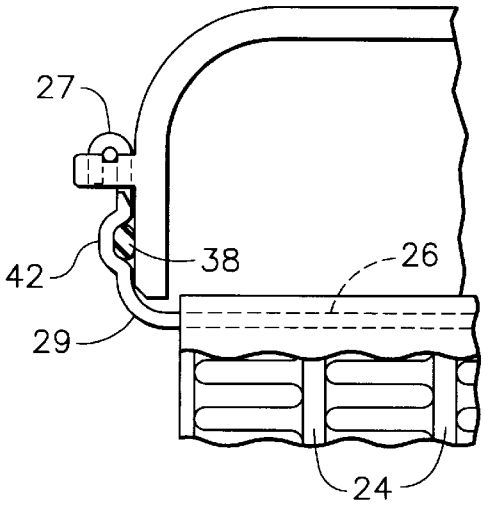
FIG. 9 is an illustration of a cross-sectional view of a tank to header joint in accordance with the present invention.

FIG. 9 is an illustration of a cross sectional view of a tank to header joint in accordance with yet another alternate preferred embodiment of the present invention wherein a header plate 26 includes a formed tank receiving member 28 similar to that described in relation to FIG. 4*a* with the addition of a seal receiving channel 42 therein between the bend 29 and hook 27. An elastomeric seal 38 can be inserted in the channel 42 for sealing the header 26 to the tank 30. The header receiving member 32 of the tank 30 is similar to that illustrated in FIG. 4*a* with the omission of a seal channel 37.

Figure 10:
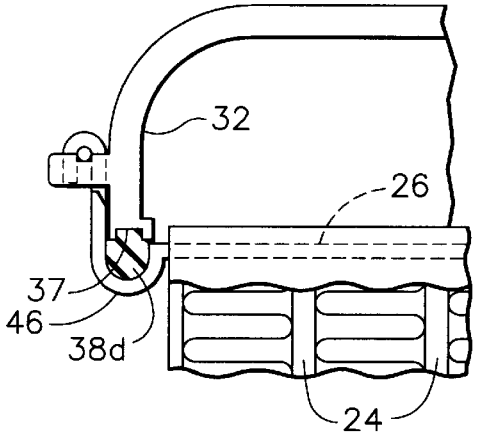
FIG. 10 is an illustration of a cross-sectional view of a tank to header joint in accordance with the present invention.

FIG. 10 is an illustration of a cross sectional view of a tank to header joint in accordance with an alternate preferred embodiment of the present invention wherein a header plate 26 includes tank receiving portion 28 of the header 26 similar to that described in relation to FIG. 4*a* with the addition of a seal receiving recess 46 proximate the header plate 26. The header receiving portion 32 of the tank 30 is similar to that illustrated in FIG. 4*a* with the seal channel 37 being repositioned as face seal channel 37 proximate the bend 29 for receiving an elastomeric face seal 38*d* therein. The face seal 38*d* provides sealing contact between the tank 30 and the header 26 along the tube axis X and also transverse to the tube axis X. Upon assembly of the tank and header, a shaped joint is formed wherein the seal 38*d* residing in the end portion 37 of the tank formed header receiving portion 28 is inserted within a mating with the recess 46 of the header 26.

Figure 11:
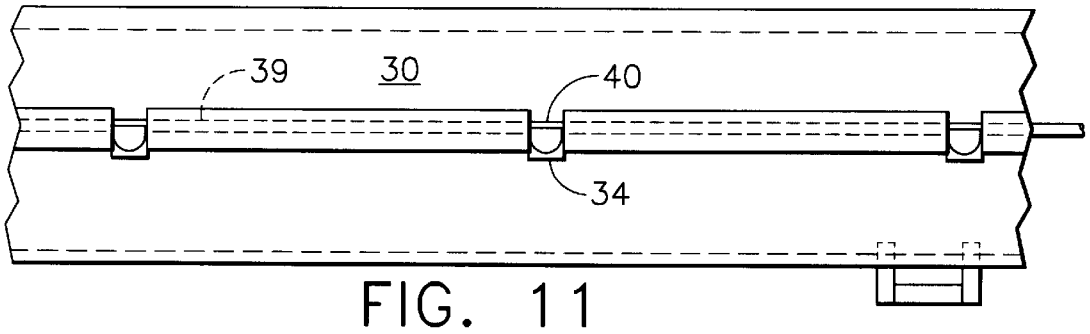
FIG. 11 is an illustration of a front view of a portion of a tank to header joint in accordance with the present invention.

FIG. 11 is an illustration of a front view of a portion of a tank to header joint showing hooks 27 and 39 disposed between tabs 34. A wire rod or pin 40 is inserted between the hooks and the tabs 34.

The disclosed structure provides an improved heat exchanger wherein the tube to header joints exhibit improved resistance to vibrational and torsional stresses. Accordingly, the present invention provides a simplified and easily assembled tube to header joint.

While a preferred embodiment of the present invention has been illustrated and described, it should be apparent to those skilled in the art that numerous modifications in the illustrated embodiment can be readily made. For instance, as has been discussed above the hooks and tabs can be alternated between the header and tank members. Similarly the seal can be alternated or split between the tank and header members. The disclosed structure can be applied to a variety of metal materials; the thickness of the metals can be altered; length and configuration of the tubes and headers can be configured to provide improved resistance to torsional and vibrational stress and improved durability. The tanks can be constructed of plastic, metal or composite. The header and tubes can be constructed of copper, brass or aluminum.

The embodiments of the invention that are claimed as exclusive property are as follows:

1. An easily assembled tank to header joint for a parallel tube heat exchanger comprising:

a header having a formed tank receiving portion, said tank receiving portion including a first locking end portion having one of spaced tabs and U shaped portions and further including a sealing surface substantially parallel to the parallel tubes;

a tank having a formed header receiving portion for engagement with said tank receiving portion of the header and including a second locking end portion having the other of spaced tabs and U shaped portions and further including a sealing surface substantially parallel to the parallel tubes;

an elastomeric seal disposed between the sealing surfaces of said formed tank and header receiving portions, said tank including a channel in the header receiving portion for fixedly receiving the seal; and a removable locking wire rod or pin for insertion between the first and second locking portions wherein the rod alternately contacts the spaced tabs and U shaped portions.

2. The easily assembled tank to header joint of claim 1, wherein the seal comprises first and second seal portions and the tank formed header receiving portion includes first and second channels for receiving said seal portions.

3. A method of assembling an easily assembled tank header joint comprising the steps of:

providing a header having a formed tank receiving portion, said tank receiving portion including a first locking end portion having one of spaced tabs and U shaped portions and further including a sealing surface substantially parallel to the parallel tubes;

providing a tank having a formed header receiving portion, said header receiving portion including a second locking end portion having the other of spaced tabs and U shaped portions; and fixedly mounting an elastomeric seal in a channel included in the sealing surface of the header receiving portion;

inserting the header receiving portion into the tank receiving portion such that the elastomeric seal is disposed between said formed tank and header receiving portions; and inserting a removable locking pin between the first and second locking portions wherein the pin alternately contacts the spaced tabs and U shaped portions.

* * * * *